United States Patent [19]

Klawitter

[11] Patent Number: 4,550,503

[45] Date of Patent: Nov. 5, 1985

[54] TOY COMPUTER IMAGE PROCESSOR ASSEMBLY

[75] Inventor: Ronald R. Klawitter, Hermann, Mo.

[73] Assignee: Handi-Pac, Inc., Hermann, Mo.

[21] Appl. No.: 621,196

[22] Filed: Jun. 15, 1984

[51] Int. Cl.[4] ..... B43L 13/00

[52] U.S. Cl. ..... 33/18 R; 33/1 M; 33/23 C; 346/139 B

[58] Field of Search ..... 33/18 R, 23 C, 1 M; 346/21, 29, 139 R, 139 B

[56] References Cited

U.S. PATENT DOCUMENTS 3,500,154 3/1970 Arp et al. ..... 33/18 R 4,135,303 1/1979 Gresset ..... 33/18 R 4,233,740 11/1980 Bunn et al. ..... 33/1 M 4,364,176 12/1982 Cassagnes et al. ..... 33/18 R 4,451,985 6/1984 Pullman ..... 33/18 R

*Primary Examiner*—William D. Martin, Jr.

[57] ABSTRACT

A toy computer image processor assembly wherein a toy assembly in the form of a simulated computer is provided with hand manipulated actuating members in a keyboard section connected to image producing means in a screen section to selectively move such image producing means into and out of engagement with the screen and in selected directions along the screen.

5 Claims, 5 Drawing Figures

TOY COMPUTER IMAGE PROCESSOR ASSEMBLY

BACKGROUND OF THE INVENTION

The present invention relates to a toy assembly and more particularly to a toy assembly which is fashioned to simulate an image processing computer.

Toy assemblies wherein hand manipulated actuating means causes movement of a member connected thereto through mechanical linkage and/or electrical linkage have long been known in the amusement toy art. Such arrangements, which often have been adopted to simulate adult mechanical and electrical tools, vehicles and play equipment, have served to stimulate the interest of children, being not only amusing and entertaining but instructive and educational as well. Among such broad category of toy assemblies has been the well known tracing device assembly disclosed in expired U.S. Pat. No. 3,055,113 issued to Arthur Grandjean on Sept. 25, 1962, which patent teaches the principle of covering a translucent glass screen with an adhering pulverulent material to make the screen opaque and then moving a mechanically controlled stylus thereover in a continuous, uninterrupted line to remove from such glass screen the pulverulent material in the path of such stylus to produce an image on the screen. The more recent, unexpired U.S. Pat. No. 3,760,505, issued to Earl D. Clark on Sept. 25, 1973, teaches a safety improvement for the casing of the tracing assembly of Grandjean, U.S. Pat. No. 3,055,113 by utilizing a protective plastic sheet to cover the translucent glass tracing surface and to further seal the escape of pulverulent or powder material.

The present invention provides a toy assembly which provides an improved tracing device over that of the aforementioned Grandjean device, recognizing the disadvantages of the continuous line tracing of Grandjean and teaching an arrangement wherein such continuous line tracing can be interrupted by selectively removing the stylus from contact with the translucent tracing surface. Further, the present invention avoids a major safety problem of past tracing devices, by utilizing a translucent plastic material as the tracing surface instead of a readily breakable glass tracing surface. In addition, the present invention incorporates these aforementioned improved tracing features into an assembly similar to that of copending patent application Ser. No. 621,197, filed June 15, 1984, to simulate an image processing computer which serves to introduce to and stimulate a young child's awareness, interest and participation in the "high technology" computer age. Moreover, the toy assembly of the present invention serves to enhance and improve the artistic and manipulative skills and hand-eye coordination of young children and, at the same time, provides participating children with many hours of busy, amusing, educational and entertaining occupation. Furthermore, the present invention provides a toy construction which can be readily manufactured and assembled with a minimum of steps and parts. Various other features of the present invention will become obvious to one skilled in the art upon reading the disclosure set forth herein.

SUMMARY OF THE INVENTION

More particularly, the present invention provides a toy assembly comprising: a closed housing; a flat translucent sheet forming a screen on the front surface of the housing; powdered material disposed in the housing adapted to move toward the inner surface of the sheet to adhere thereto and render the sheet opaque; manual actuating means mounted on the housing for manual manipulation by a child; image producing means moveably mounted in the housing adjacent the translucent sheet; and mechanical linkage means disposed within the housing connected at one end to the manual actuating means mounted on the housing and at the other end to the image producing means to selectively move the image producing means into and out of contact with the powdered surface of the sheet and in selected contacting directions along the sheet to remove powdered material thereform and produce preselected images thereon. In addition the present invention provides a novel arrangement wherein the housing of the aforedescribed assembly is in the form of a computer console including a keyboard section and a screen section, the manual actuating means being mounted in the keyboard section and the image producing means being mounted in an enclosed casing in the screen section and mechanical linkage means being provided within the housing to connect the manual actuating means to the image producing means.

It is to be understood that various changes can be made in the arrangement, form and construction of the apparatus described herein without departing from the scope or spirit of the present invention.

BRIEF DESCRIPTION OF THE DRAWINGS

Referring now to the drawings which disclose an advantageous embodiment of the toy computer image processor assembly of the present invention:

Referring to FIG. 1, housing 2, which is in a form simulating a computer console, includes a generally horizontally disposed keyboard section 3 and a generally vertically disposed screen section 4. The console housing 2 can be formed from two or more parts of any one of a number of suitably strong materials, such as a polyurethane plastic—as can most of the parts described hereinafter—and can be snapfitted together after the mechanical linkage has been appropriately assembled therein in a manner described hereinafter. It is to be understood that although the relative positions of the keyboard and screen sections can be altered if so desired, the position disclosed in the drawings more closely simulates most computer image processing assemblies presently known in the "high technology" market place.

Figure 1:
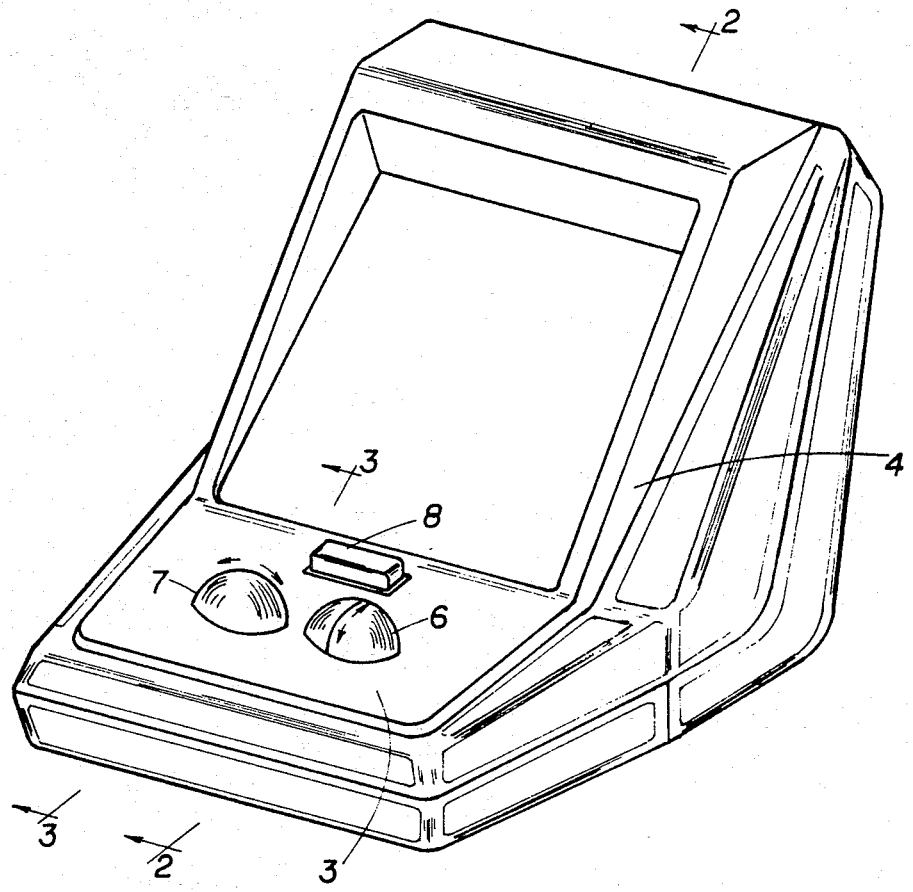
FIG. 1 is a perspective view of the overall toy assembly.

As disclosed in FIG. 1 of the drawings, the keyboard section 3 includes two space manual actuating members in the form of balls 6 and 7. The ball 6 is manually moveable in an up or down motion to impart up or down movement of a stylus on screen section 4, as described hereinafter. The ball 7 is manually moveable in a side-to side motion to impart side-to-side movement of the stylus on screen section 4, as also described hereinafter. The keyboard section further includes a pivotally mounted skip button 8 which, when pivoted, causes in-out movement of the stylus relative a translucent sheet in screen section 4, as also described hereinafter.

Figure 2:
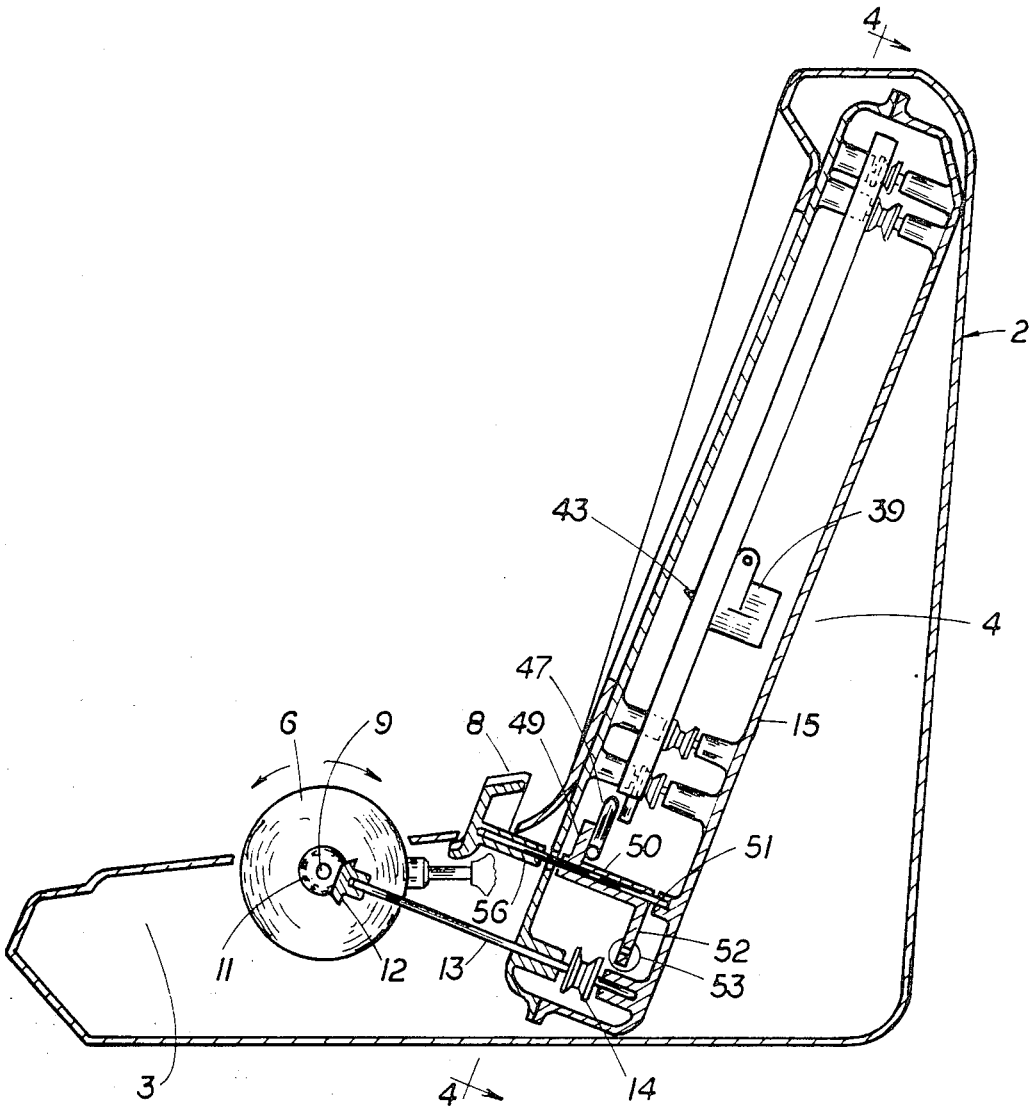
FIG. 2 is an enlarged cross-sectional side view of the toy assembly of FIG. 1 taken in a plane through line 2—2 of FIG. 1.
Figure 4:
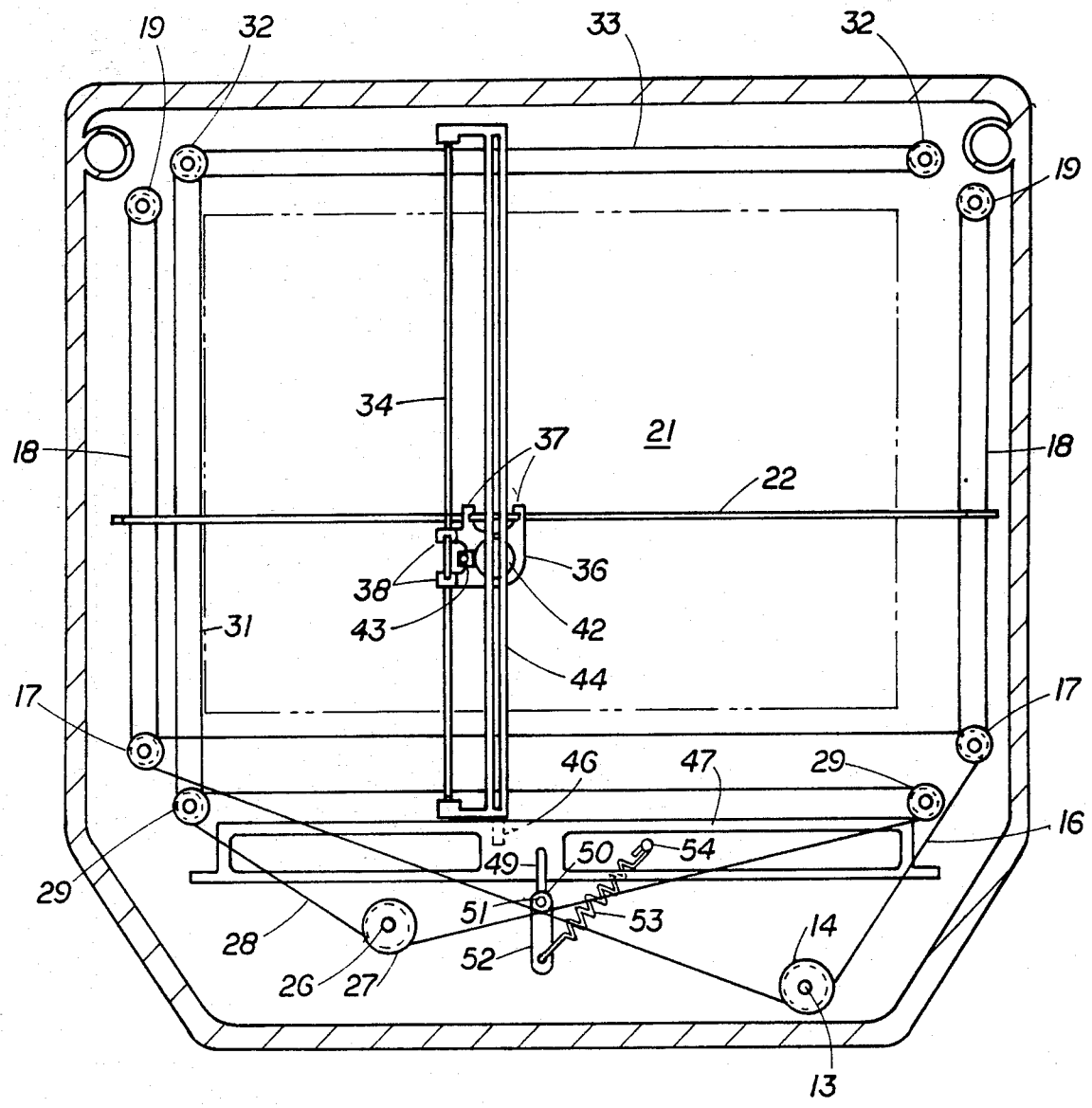
FIG. 4 is an enlarged cross-sectional front view of the toy assembly taken in a plane through line 4—4 of FIG. 2; and, FIG. 5 is an enlarged isometric schematic view of the mechanism for moving the stylus into and out of engagement with the screen sheet.

Referring to FIGS. 2 and 4 of the drawings, it can be seen that rotary movement of ball 6 toward or away from screen section 4 imparts rotary motion to axle 9 which extends parallel screen section 4 to impart rotary motion to bevel gear 11 also mounted on axle 9. Bevel gear 11 engages with bevel gear 12 mounted on one extremity of rotatable shaft 13 which extends from keyboard section 3 to an enclosed and sealed casing 15 in screen section 4. A sheave 14 is mounted on the other extremity of shaft 13 for rotation therewith in enclosed casing 15. Sheave 14, in turn, is connected through endless cable 16 in casing 15 to the lower sheaves 17 for vertically extending spaced endless cable pairs 18 also mounted in casing 15 on the lower spaced sheaves 17 and the upper spaced sheaves 19 to extend along the opposite vertical sides of plastic translucent screen sheet 21 forming one face of casing 15. Fastened to spaced vertically extending endless cables 18 for up or down movement thereon in casing 15 are the opposite extremities of horizontal stylus housing support rod 22.

Figure 3:
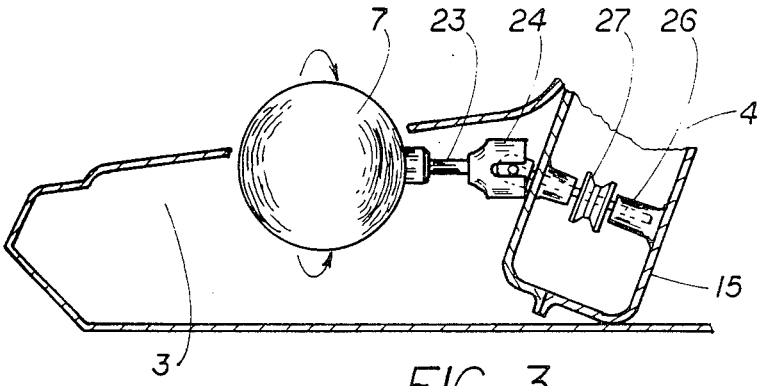
FIG. 3 is an enlarged cross-sectional side view of the toy assembly of FIG. 1 taken in a plane through line 3—3 of FIG. 1.

Referring to FIG. 3 of the drawings, ball 7 in keyboard section 3 is adapted to rotate from side-to-side about an axis perpendicular to screen section 4, imparting a rotational motion to axle 23 connected thereto. The opposite end of axle 23 is connected through a universal assembly 24 to shaft 26 rotatably mounted in enclosed casing 15. Mounted on shaft 26 in casing 15 is a sheave 27. Sheave 27 is connected by an endless cable 28 to the spaced lower sheaves 29 with one side or flight of cable 28 extending parallel to the lower horizontally extending side of translucent sheet 21. A vertically extending endless cable 31 parallel to a vertically extending side of translucent screen 21 and mounted between one of spaced lower sheaves 29 and one of spaced upper sheaves 32 serves to drive endless cable 33 mounted between spaced upper sheaves 32. Endless cable 33 extends in a horizontal fashion above the upper horizontally extending side of translucent screen 21. Fastened to one flight of upper horizontally extending endless cable 33 and the horizontally extending flight of cable 28 are the opposite extremities of a vertical stylus housing support rod 34. It is to be noted that rods 22 and 34 are positioned at right angles to each other and are adapted to move in orthogonal directions relative each other by action of the aforedescribed endless cable system. The rod 34 moves in a side-to-side direction in accordance with the side-to-side motion of ball 7 (FIG. 3). The rod 22 moves in an up or down direction in accordance with the up or down motion of ball 6 (FIG. 2).

Figure 5:
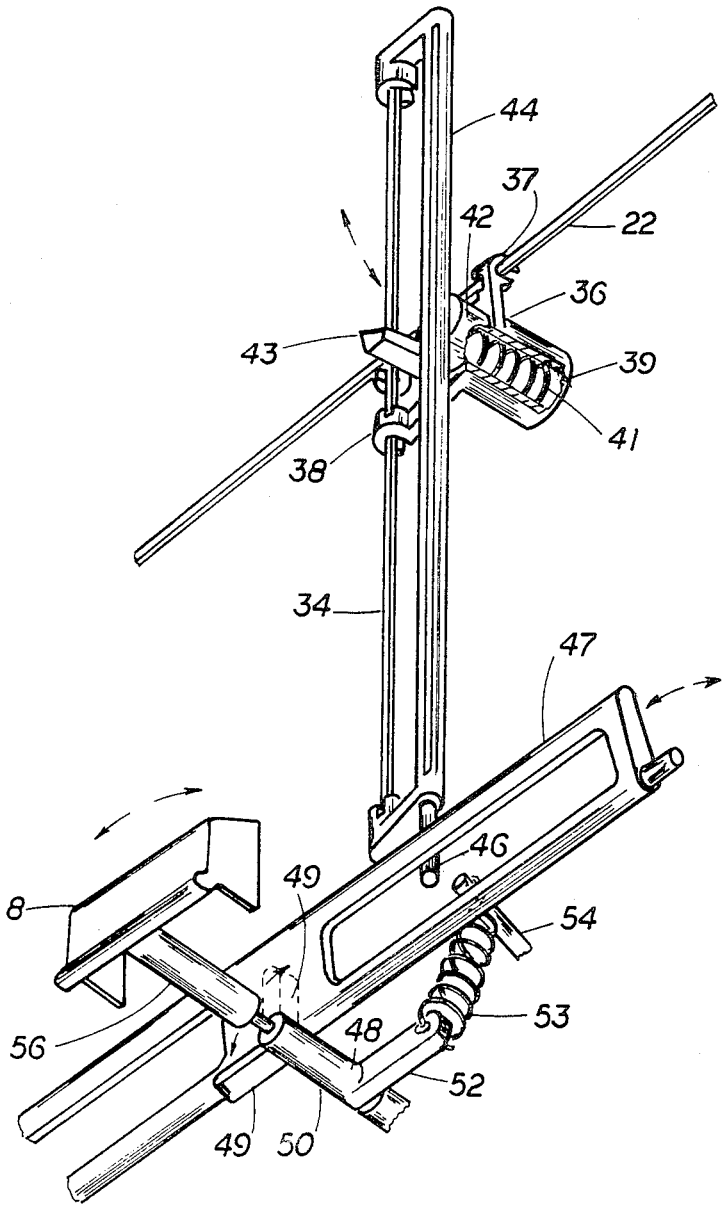

Referring to FIGS. 4 and 5, it can be seen that rods 22 and 34 serve to support stylus housing 36 slidably mounted on the rods 22 and 34 by spaced arm sets 37 and 38 respectively extending at right angles from housing 36. Stylus housing 36 includes a cylindrical spring retaining shell or housing 39 adapted to receive compression spring 41. A stylus button 42 from which stylus 43 extends slidably nests with shell or housing 39. As can be seen in FIGS. 4 and 5, a U-shaped arm 44 extends parallel to vertically extending stylus housing support rod 34 and is pivotally mounted thereto at opposite extemities thereof. Arm 44 which is positioned to pass over and abut stylus button 42 regardless of the position of stylus housing 36 is provided at one extremity thereof with an extension pin 46. Pin 46 is overlapped and abutted by pivotally mounted, horizontally extending rib 47 (FIG. 4). It is to be noted that compression spring 41 normally urges stylus 42 into engagement with translucent plastic screen sheet 21.

To move stylus 42 away from translucent screen sheet 21, pivotal rib member 47 is cam actuated to urge against extension pin 46. U shaped arm 44 pivots about rod 34 to abut stylus button 42, moving stylus 43 away from screen sheet 21 and compressing spring 41 in casing or housing 39. This movement of pivotal rib 47 is accomplished through the cam assembly 48.

Cam assembly 48 includes a cam arm 49 extending at a right angle from one extremity of pivotal sleeve 50 mounted on shaft 51 and a spring arm 52 extending from the other extremity of sleeve 50 at a right angle in an opposite direction from cam arm 49. The extremity of spring arm 52 is connected to one end of a tension spring 53, the other end of tension spring 53 being moored to post 54. It will be noted that tension spring 53 normally urges cam arm 49 out of abutting engagement with pivotal rib 47. To urge cam arm 49 in abutting engagement with pivotal rib 47 it is only necessary to rotate shaft 51. This is accomplished by moving one end of pivotal skip button 8 which has a sleeve 56 extending at right angle therefrom to engage shaft 51 and impart rotation thereto.

As in the Grandjean patent, enclosed casing 15 is provided with a fine metallic powder or pulverulent material to render translucent screen sheet 21 opaque when covered with such material. With rotation of the balls 6 and 7, the stylus 43 is caused to move in an up or down and side-to-side motion respectively to produce a preselected line or lines on the screen. It only is necessary for a child to press skip button 8 to withdraw the stylus 43 from screen contact. With a release of pressure on the skip button 8, the stylus again moves into screen contact. When the image forming lines are to be removed from sheet 21, the housing is tilted or shaken so that the powder again will cover sheet 21 where it has been removed by the moving stylus 43. The powder usually is a metallic powder, such as aluminum and small beads or particles can be inserted in casing 15 along with the powder to facilitate even surface distribution.

The invention claimed is:

1. A toy assembly simulating an image processing computer comprising: a closed console housing including a keyboard section and a screen section; manual actuating means mounted on said keyboard section for manual manipulation by a child; image producing means movably mounted in said screen section; a flat translucent sheet forming the front surface of said screen section; powdered material disposed in said housing adapted to move toward the inner surface of said sheet to adhere thereto and render said sheet opaque; and mechanical linkage means disposed within said console housing connected at one end to said manual actuating means on said keyboard section and at the other end to said image producing means in said screen section to selectively move said image producing means into and out of contact with said powdered surface of said sheet and in selected contacting directions along said sheet to remove powdered material therefrom and produce preselected images thereon, said manual actuating means on said keyboard section including separate members to control the directional movement of said image producing means along said powdered sheet and to control the movement of said image producing means into and out of contact with said powdered sheet, said image producing means including a movably mounted stylus; spring means to urge said movably mounted stylus in one direction relative said powdered sheet; and spring compression means to move said movably mounted stylus in an opposite direction, said spring compression means being mechanically linked to said manual actuating member which controls movement of said image producing means into and out of contact with said powdered sheet.

2. A toy assembly simulating an image processing computer comprising: a closed console housing including a keyboard section and a screen section; manual actuating means mounted on said keyboard section for manual manipulation by a child; image producing means movably mounted in said screen section; a flat translucent sheet forming the front surface of said screen section; powdered material disposed in said housing adapted to move toward the inner surface of said sheet to adhere thereto and render said sheet opaque; and mechanical linkage means disposed within said console housing connected at one end to said manual actuating means on said keyboard section and at the other end to said image producing means in said screen section to selectively move said image producing means into and out of contact with said powdered surface of said sheet and in selected contacting directions along said sheet to remove powdered material therefrom and produce preselected images thereon, said manual actuating means on said keyboard section including separate members to control the directional movement of said image producing means along said powdered sheet and to control the movement of said image producing means into and out of contact with said powdered sheet, said mechanical linkage means including a pair of rods extending transverse said sheet at right angles to each other; actuating cables connected to the manual actuating member to control the directional movement of said image producing means and to the ends of said rods to support and move the same in directions at right angles relative each other; said image producing means including a stylus housing slidably mounted on each of said rods; a stylus movably mounted on said housing; a spring urged pressure member connected to said stylus to yieldingly urge said stylus into contacting engagement with said powdered sheet; an arm pivotally mounted on one of said rods to engage said pressure member; a rib member pivotally mounted along one side of said sheet and adapted to urgingly engage said arm; and camming means connected to said manual actuating member which controls movement of said image producing means into an out of contact with said sheet, said camming means abutting said pivotal rib member whereby camming pressure on said rib member places pressure on said pivotal arm to compress said spring urged pressure member and move said movably mounted stylus out of contact with said screen.

3. A toy assembly comprising: a closed housing; a flat translucent sheet forming a screen on the front surface of said housing; powdered material disposed in said housing adapted to move toward the inner surface of said sheet to adhere thereto and render said sheet opaque; manual actuating means mounted on said housing for manual manipulation by a child; image producing means movably mounted in said housing adjacent said translucent sheet; and mechanical linkage means disposed within said housing connected at one end to said manual actuating means mounted on the housing and at the other end to said image producing means to selectively move said image producing means into and out of contact with said powdered surface of said sheet and in selected contacting directions along said sheet to remove powdered material therefrom and produce preselected images thereon, said mechanical linkage means including a pair of rods extending transverse said sheet at right angles to each other; actuating cables connected to the manual actuating members to control the directional movement of said image producing means and to the ends of said rods to support and move the rods in directions at right angles relative to each other; said image producing means including a stylus housing slidably mounted on each of said rods; a stylus movably mounted on said housing connected by said mechanical linkage means to said manual actuating member to control the movement of said stylus into and out of contact with said sheet.

4. A toy assembly comprising: a closed housing; a flat translucent sheet forming a screen on the front surface of said housing; powdered material disposed in said housing adapted to move toward the inner surface of said sheet to adhere thereto and render said sheet opague; manual actuating means mounted on said housing for manual manipulation by a child; image producing means movably mounted in said housing adjacent said translucent sheet; and mechanical linkage means disposed within said housing connected at one end to said manual actuating means mounted on the housing and at the other end to said image producing means to selectively move said image producing means into and out of contact with said powdered surface of said sheet and in selected contacting directions along said sheet to remove powdered material therefrom and produce preselected images thereon, said mechanical linkage means including a pair of rods extending transverse said sheet at right angles to each other; said image producing means including a stylus housing slidably mounted on each of said rods; a stylus movably mounted on said housing; a spring urged pressure member connected to said stylus to yieldingly urge said stylus into contacting engagement with said powdered sheet; an arm pivotally mounted on one of said rods to engage said pressure member; a rib member pivotally mounted along one side of said sheet and adapted to urgingly engage said arm; and camming means connected to said manual actuating member which controls movement of said image producing means into and out of contact with said sheet, said camming means abutting said pivotal rib member whereby camming pressure on said rib member places pressure on said pivotal arm to compress said spring urged pressure member and move said movably mounted stylus out of contact with said screen.

5. A toy assembly simulating an image processing computer comprising: a console housing including a keyboard section disposed in a generally horizontal position and a screen section disposed in a generally vertical position, a flat translucent plastic sheet forming the front surface of said screen section; powdered material disposed in said casing adapted to move toward the inner surface of said sheet to adhere thereto and render said sheet opaque; a pair of rods disposed in said screen section to extend transverse said sheet at right angles to each other with one rod extending vertically and the other rod horizontally with respect to said sheet; actuating cable assemblies disposed within said screen section and connected to the ends of each of said rods to support and move the rods, one in a horizontal up and down direction and the other in a side-to-side vertical direction; spaced first and second ball members rotatably mounted in said keyboard section, one being mechanically linked through a meshing bevel gear and shaft assembly to said actuating cable assembly for said horizontally extending rod and the other being mechanically linked through a shaft and universal drive assembly to said actuating cable assembly, for said vertically extending rod; a stylus housing having support arms slidably mounted on each of said rods; a stylus moveably mounted on said housing; a spring urged pressure button yieldingly urging said moveably mounted stylus into contacting engagement with said powdered sheet; a vertical arm extending parallel to said vertically extending rod in spaced relation thereto to contact said spring urged pressure button, said vertical arm being pivotally mounted at its extremities to the extremities of said vertically extending rod and having a pin extension projecting from the lower extremity thereof; a pivotally mounted horizontal rib extending along the lower side of said sheet to overlap said pin extension; a spring loaded pivotal caming arm mounted in said console to pivotally engage said horizontal rib; and a pivotal actuating button mounted in said keyboard section connected to said caming arm to cause said caming arm to move said horizontal rib against said pin extension of said vertical arm to press said spring urged pressure button moving said moveably mounted stylus out of contact with said screen.

* * * * *